US010635017B2

(12) United States Patent
Hotogi

(10) Patent No.: US 10,635,017 B2
(45) Date of Patent: Apr. 28, 2020

(54) IMAGE FORMING APPARATUS FOR PERFORMING EXPOSURE USING LASER LIGHT

(71) Applicant: CANON KABUSHIKI KAISHA, Tokyo (JP)

(72) Inventor: Tatsuya Hotogi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/226,352

(22) Filed: Dec. 19, 2018

(65) Prior Publication Data

US 2019/0196354 A1 Jun. 27, 2019

(30) Foreign Application Priority Data

Dec. 27, 2017 (JP) ..... 2017-252544

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04072* (2013.01)

(58) Field of Classification Search
CPC ..... G03G 15/043; G03G 15/04072; G03G 15/228; G03G 15/234
See application file for complete search history.

(56) References Cited

U.S. PATENT DOCUMENTS

2017/0285510 A1* 10/2017 Furuta ..... G03G 15/043

FOREIGN PATENT DOCUMENTS

| | | | |
|---|---|---|---|
| JP | 08-094948 | A | 4/1996 |
| JP | 08-252945 | A | 10/1996 |
| JP | 9-123519 | A | 5/1997 |
| JP | 2007-062223 | A | 3/2007 |

* cited by examiner

*Primary Examiner* — Hoang X Ngo
(74) *Attorney, Agent, or Firm* — Canon U.S.A., Inc. IP Division

(57) ABSTRACT

A control unit performs first control for outputting a second signal based on a first signal in a case where a cycle of the first signal is within a predetermined cycle, and performs second control for outputting a second signal based on a predicted cycle of the first signal in a case where the cycle of the first signal is out of the predetermined cycle.

18 Claims, 11 Drawing Sheets

IMAGE FORMING APPARATUS FOR PERFORMING EXPOSURE USING LASER LIGHT

BACKGROUND

Field of the Disclosure

The present disclosure relates to an image forming apparatus, such as an electrophotographic printer, that performs exposure using laser light.

Description of the Related Art

An image forming apparatus that periodically scans a photosensitive drum with laser light using a rotational polygon mirror to form an electrostatic latent image on the photosensitive drum has been known. Such an image forming apparatus includes a beam detection (BD) sensor that detects a main scanning synchronization signal (BD signal) in a main scanning direction that is a scanning direction of laser light. The BD signal is for controlling a start timing of writing in the main scanning direction. Japanese Patent Application Laid-Open No. 1997-123519 discusses control in which a BD cycle of a BD signal output from the BD sensor is detected, and when the BD cycle is not within a predetermined period, BD error is detected.

During image forming, abnormality of the BD cycle in the conventional technique occurs due to deviation of a BD signal detection timing from a predetermined timing in consequence of disturbance, for example, a slight noise. If such abnormality of the BD cycle occurs, image forming is stopped, driving of a scanner motor is stopped, a recording material is discharged out from the image forming apparatus, and the image forming is then executed again. This is so-called print error processing.

However, even if abnormality in the BD cycle is detected because the detection timing of the BD signal temporarily deviates from the predetermined timing in consequence of disturbance, for example a slight noise, the BD cycle sometimes returns back to a normal cycle. In such a case, if the print error processing is executed merely because of the abnormality of the BD cycle although the image forming may be continued, a downtime until the image forming is resumed is taken and recording materials and toner are consumed. That is, usability may be deteriorated.

SUMMARY

According to an aspect of the present disclosure, an image forming apparatus including a light source, a rotational polygon mirror configured to deflect light output from the light source while being rotationally driven, the rotational polygon mirror including a plurality of reflection surfaces, a driving unit configured to drive the rotational polygon mirror, a detection unit configured to output a first signal based on detection of the light deflected by the rotational polygon mirror, and a control unit configured to output a second signal that is a synchronization signal for controlling start of writing in a main scanning direction, based on the first signal, wherein the control unit performs first control for outputting the second signal based on the first signal in a case where a cycle of the first signal is within a predetermined cycle, and performs second control for outputting the second signal based on the cycle of the first signal predicted in the first control in a case where the cycle of the first signal is out of the predetermined cycle.

Further features of the present disclosure will become apparent from the following description of exemplary embodiments with reference to the attached drawings.

DESCRIPTION OF THE EMBODIMENTS

Exemplary embodiments of the present disclosure are described below with reference to the drawings. The following exemplary embodiments do not limit the disclosure in the scope of claims, and not all combinations of features described in the exemplary embodiments are necessarily essential for means for solving the disclosure.

[Image Forming Apparatus]

Figure 1:
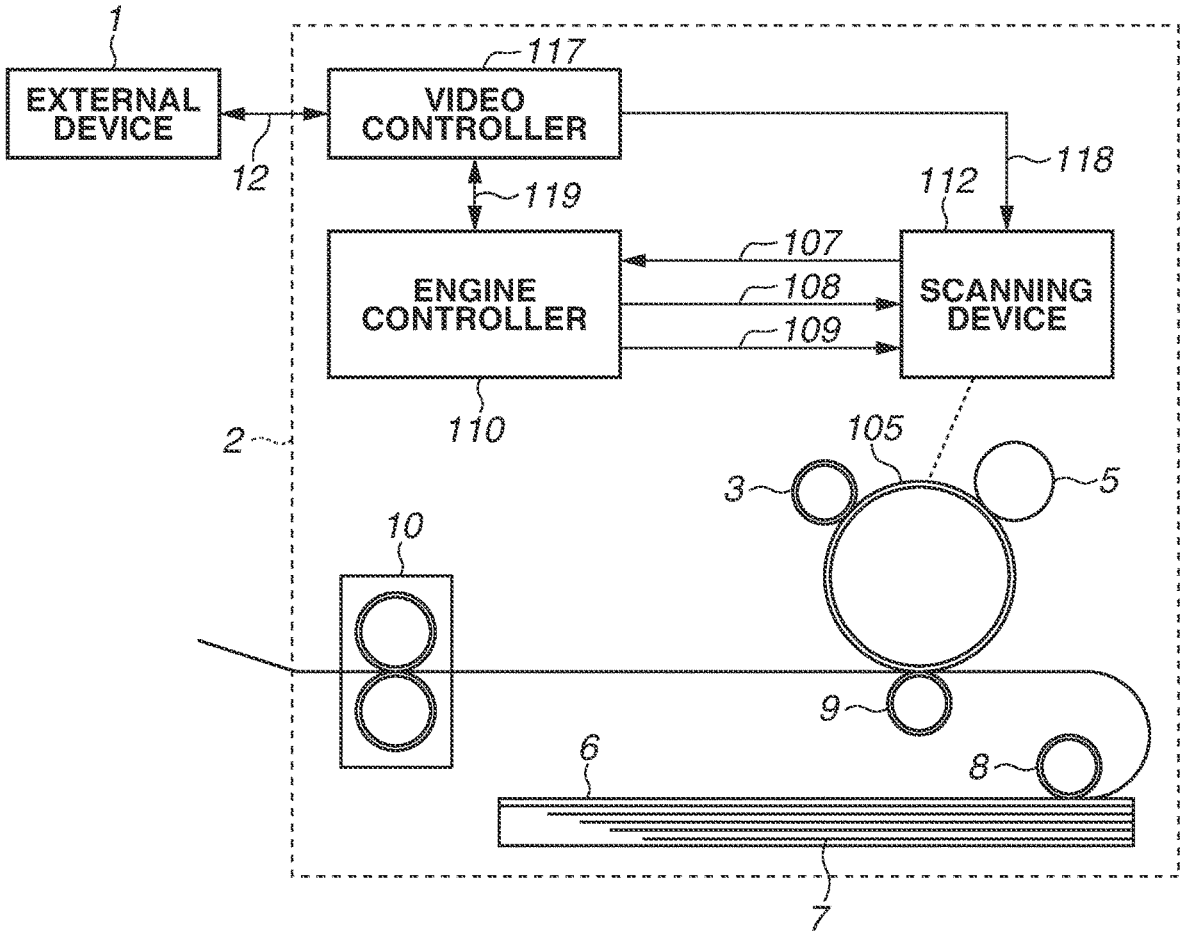
FIG. 1 is a diagram illustrating a schematic configuration of an image forming apparatus.

FIG. 1 is a schematic configuration diagram of an image forming apparatus 2. In the following description, a monochrome image forming apparatus is described, but the present disclosure is not limited to this. For example, the present disclosure is applicable also to a color image forming apparatus. The color image forming apparatus may employ, for example, an in-line method using an intermediate transfer belt, a rotary method, or a direct transfer method.

The image forming apparatus 2 can be connected to an external device 1, such as a personal computer (PC). The image forming apparatus 2 includes an engine controller 110 as an example of a control unit, and a video controller 117. The engine controller 110 controls operations of each member provided inside the image forming apparatus 2. The video controller 117 as an image control unit is connected to the external device 1 via a general-purpose interface 12. The video controller 117 rasterizes image data transmitted from the external device 1 into bit data, and transmits the bit data as an image signal 118 to a scanning device 112. The engine controller 110 and the video controller 117 are connected to each other using an interface signal 119. Further, herein, the engine controller 110 and the video controller 117 are configured as individual units as an example, but the engine controller 110 can include a function of the video controller 117.

When a print starting instruction is transmitted from the external device 1, the engine controller 110 uniformly charges a surface of a photosensitive drum 105 as a photosensitive member using a charge roller 3. The scanning device 112 performs exposure scanning with laser light on the surface of the photosensitive drum 105 based on the image signal 118 transmitted from the video controller 117 to form an electrostatic latent image. The configuration of the scanning device 112 and the control of exposure scanning with laser light are described in detail below.

The formed electrostatic latent image is developed by toner (developer) held on a surface of a development roller 5, and thus a toner image is formed on the photosensitive drum 105 (photosensitive member). A recording material 7, such as paper sheets, accommodated in a sheet feeding cassette 6 is then fed by a feed roller 8. The toner image formed on the photosensitive drum 105 is transferred onto the recording material 7 by a transfer roller 9 in synchronization with a conveyance operation for the fed recording material 7. The recording material 7 onto which the toner image has been transferred is conveyed to a fixing device 10, the toner image is fixed to the recording material 7 by heat and pressure, and the recording material 7 to which the toner image has been fixed is discharged out from the image forming apparatus 2.

[Scanning Device]

Figure 2:
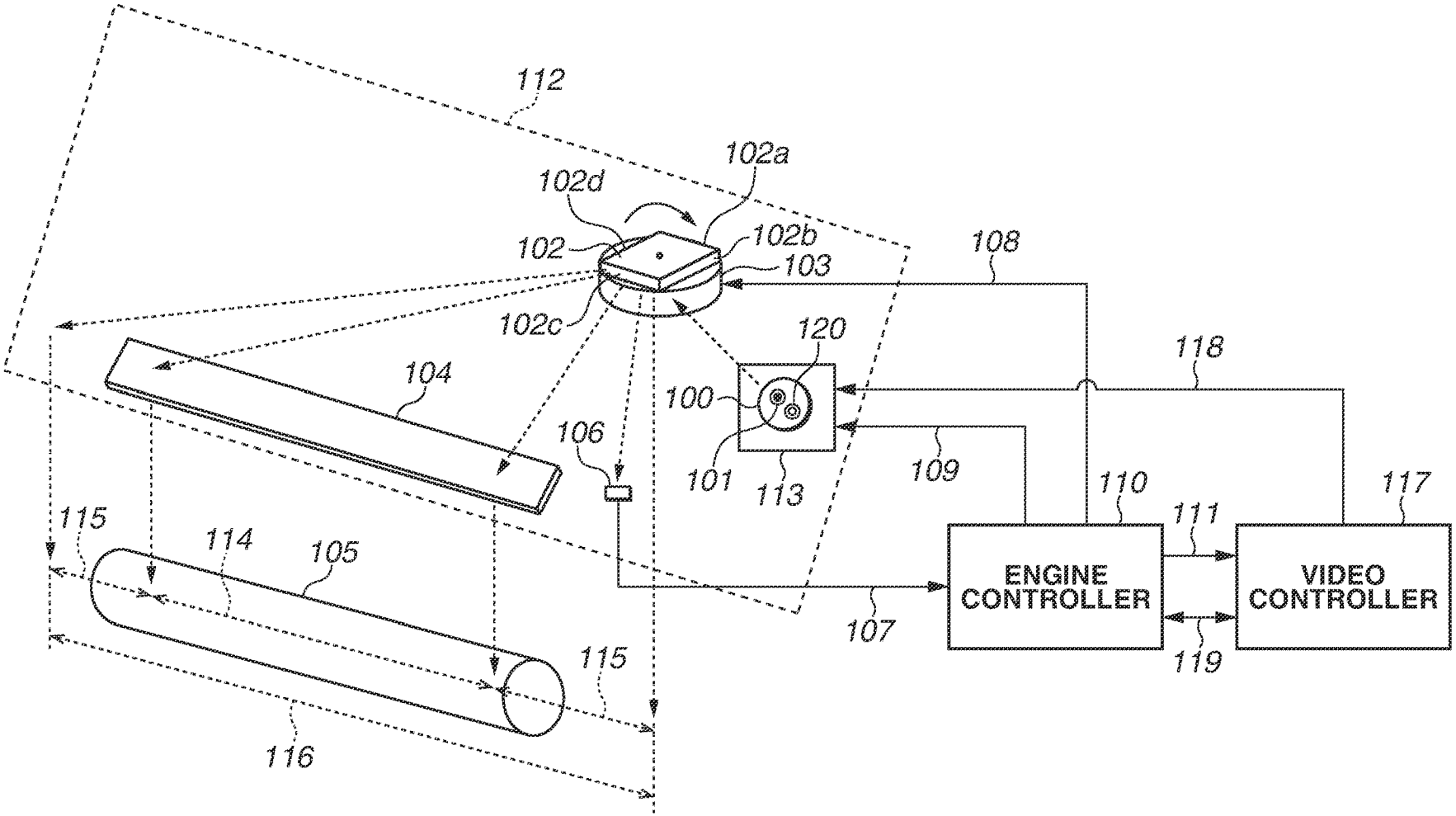
FIG. 2 is a perspective view illustrating a schematic configuration of a scanning device.

FIG. 2 is a perspective view illustrating a schematic configuration of the scanning device 112. The semiconductor laser 100 is a light source that is used for the exposure to form an image. The semiconductor laser 100 includes a laser diode 101 and a photo diode 120. Light emission is controlled by a laser drive circuit 113. A polygon mirror 102 as a rotational polygon mirror includes a plurality of reflection surfaces 102*a*, 102*b*, 102*c*, and 102*d*, i.e., four reflection surfaces according to the present exemplary embodiment. The polygon mirror 102 is rotated to an illustrated rotational direction by the scanner motor 103 that is one example of a rotation driving unit. A fall scanning region 116 is periodically scanned with laser light reflected from surfaces of the polygon mirror 102 that is being rotated. In such a manner, the polygon mirror 102 can scan the photosensitive drum 105 by reflecting laser light. The full-scanning region 116 includes an image region 114 and a non-image region 115. The image region 114 is a region on the surface of the photosensitive drum 105 where the laser light reflected from the polygon mirror 102 is projected via a reflection mirror 104. The image region 114 is scanned with laser light, and thus the electrostatic latent image is formed on the photosensitive drum 105.

The non-image region 115 is a part of the full-scanning region 116 where the image region 114 is excluded. Upon incidence of laser light, a beam detection (BD) sensor 106 that is disposed in a predetermined region of the non-image region 115 generates a horizontal synchronization signal 107 as a main scanning synchronization signal in a main scanning direction corresponding to the laser light. The horizontal synchronization signal 107 is referred to also as a beam detection input (BDI) signal 107. A cycle at which the BDI signal 107 is generated is referred to also as a BD cycle. The BDI signal 107 is used as a scanning start reference signal in the main scanning direction, and is used for controlling a writing start position in the main scanning direction. The BDI signal 107 is input into the engine controller 110.

The engine controller 110 sequentially updates the BD cycle every time when the BDI signal 107 is generated, and stores the BD cycle. Based on the stored BD cycle, the engine controller 110 controls the scanner motor 103 and the semiconductor laser 100. That is, the engine controller 110 transmits a scanner motor drive signal 108 to the scanner motor 103. If a number of rotations obtained from the current BD cycle is lower than a target number of rotations that has been set, the engine controller 110 causes the scanner motor 103 to accelerate, and if higher, the engine controller 110 causes the scanner motor 103 to decelerate. That is, speed control is made in such a manner that the number of rotations of the scanner motor 103 converges to the target number of rotations by accelerating or decelerating the scanner motor 103. Further, the engine controller 110 transmits a laser drive signal 109 to the laser drive circuit 113, and causes the semiconductor laser 100 to emit light at a predetermined timing for the full-scanning region 116. Storing the BD cycle in the engine controller 110 is one example. Alternatively, the BD cycle may be stored in, for example, another memory in the image forming apparatus 2 or in a server connected via a network.

Further, the engine controller 110 transmits a beam detection output (BDO) signal 111 as a signal for controlling a main scanning start timing for writing to the video controller 117. The video controller 117 transmits the image signal 118 in response to a BDO signal 111, and causes the semiconductor laser 100 to emit laser light based on the image signal 118. As a result, the electrostatic latent image can be formed on the photosensitive drum 105. Basically, the BDO signal 111 is transmitted using a timing at which the BDI signal 107 is generated. In each step of image forming, the engine controller 110 appropriately processes a waveform of the BDO signal 111 and transmits the BDO signal 111 to the video controller 117.

[Description About Control of BDI Signal and BDO Signal]

Figure 3:
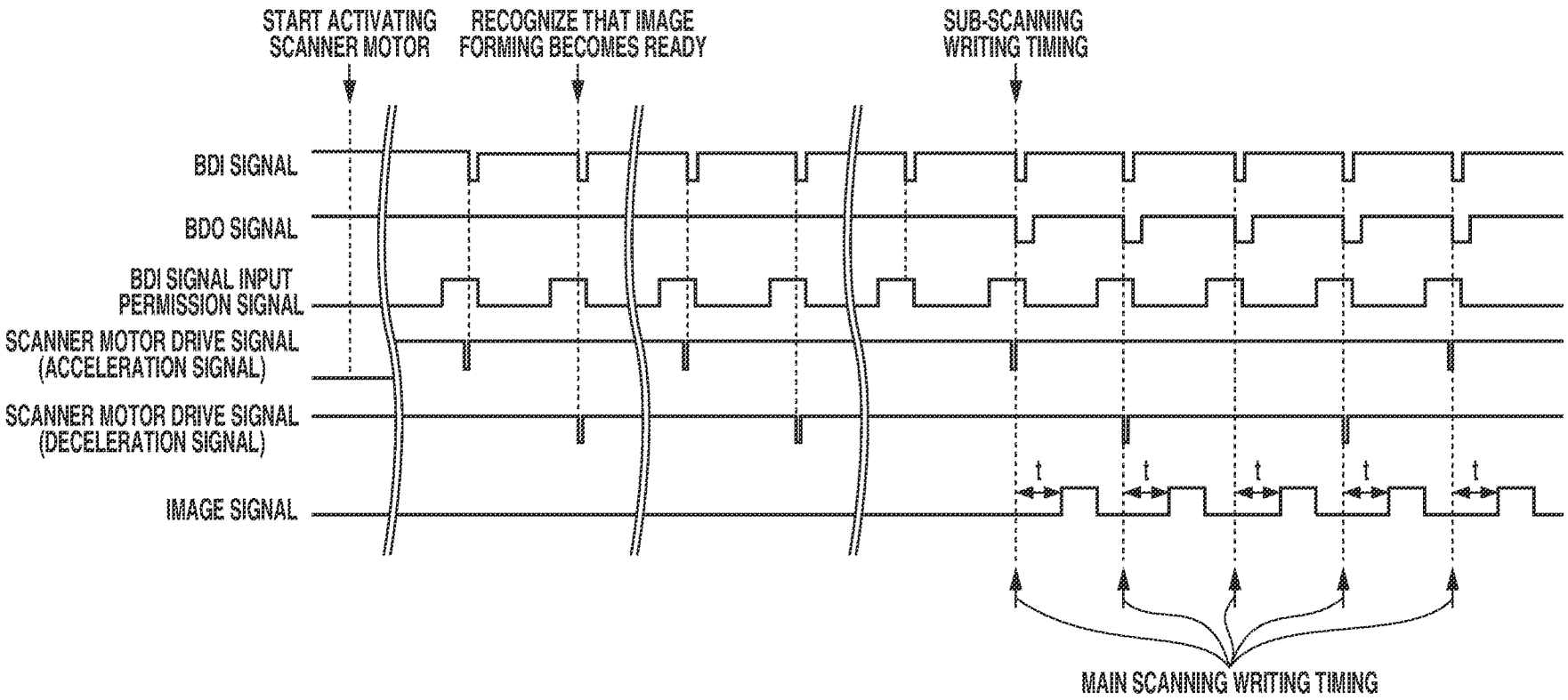
FIG. 3 is a timing chart illustrating generation of a beam detection input (BDI) signal and a beam detect output (BDO) signal.

FIG. 3 is a timing chart illustrating generation of the BDI signal 107 and the BDO signal 111. The BDI signal 107 is at a high (H) level when the BD sensor 106 does not receive laser light, and at a low (H) level when the BD sensor 106 receives laser light. Further, the scanner motor drive signal 108 is a drive signal including an acceleration signal and a deceleration signal. A combination in which the acceleration signal is at the L level and the deceleration signal is at the H level serves as an acceleration instruction. Another combination in which the acceleration signal is at the H level and the deceleration signal is at the L level serves as a deceleration instruction. When both the acceleration signal and the deceleration signal of the scanner motor drive signal 108 are at the H level, the driving is in a control neutral state in which acceleration and deceleration are not instructed.

When a print starting instruction is transmitted from the external device 1, the engine controller 110 causes the semiconductor laser 100 to start emitting laser light. The engine controller 110 brings the scanner motor drive signal 108 into the acceleration instruction state to activate the scanner motor 103. The engine controller 110 then performs speed control so that the number of rotations of the scanner motor 103 converges to a target number of rotations. In this state, an L active pulse-shaped waveform is periodically generated as the BDI signal 107 based on the rotation speed of the scanner motor 103. The BDO signal 111 is masked at the H level, and in this state, the video controller 117 is not yet requested for the image signal 118. The scanner motor drive signal 108 is brought into the acceleration instruction state or the deceleration instruction state for the set target number of rotations based on the number of rotations of the scanner motor 103. The number of rotations of the scanner motor 103 corresponds to a current BD cycle. The engine controller 110 controls the scanner motor drive signal 108 to gradually converge the number of rotations of the scanner motor 103 to the target number of rotations.

When the engine controller 110 determines from the successively obtained BD cycles that the number of rotations of the scanner motor 103 converges to the target number of rotations, the engine controller 110 recognizes that preparation for image forming is completed and image forming becomes ready. Herein, the convergence of the number of rotations of the scanner motor 103 to the target number of rotations means, for example, that the number of rotations of the scanner motor 103 converges to a range of ±0.1% of the target number of rotations. This is equivalent to the state in which generation timings of the BDI signal 107 and the BDO signal 111 are not recognized as a fluctuation of an image in the main scanning direction, and the image can be provided as a normal output image to a user. The BD cycle range corresponding to that the number of rotations of the scanner motor 103 is within the range of ±0.1% of the target number of rotations is referred to also as a normal range hereinafter.

When determining that it is the writing timing in a sub-scanning direction, the engine controller 110 transmits the BDO signal 111 to the video controller 117. The BDO signal 111 is the L-active pulse-shaped waveform synchronized with a fall timing of the BDI signal 107. When receiving the BDO signal 111, the video controller 117 recognizes a sub-scanning start timing for writing, and transmits the image signal 118 after a predetermined time t has elapsed from a fall timing of the BDO signal 111. A timing of when the BDO signal 111 is transmitted from the engine controller 110 to the video controller 117 may be before the sub-scanning writing timing. The control may be performed, for example, as follows: after the video controller 117 receives the BDO signal 111 N (N: integer) times from when the reception of the BDO signal 111 is started, the image signal 118 is transmitted.

In such a manner, during the image forming, the engine controller 110 performs speed control for the scanner motor 103 so that the number of rotations of the scanner motor 103 converges to the target number of rotations. Further, the engine controller 110 performs transmission control for the BDI signal 107 so that the BDO signal 111, which is synchronized with the fall timing of the BDI signal 107 transmitted based on the detection of laser light by the BD sensor 106, is transmitted to the video controller 117. Such control is generally referred to as first control hereinafter.

The engine controller 110 periodically generates a BDI signal input permission signal 125. The BDI signal input permission signal 125 is a signal for permitting input of the BDI signal 107 generated near a generation timing of the BDI signal 107 to be subsequently generated, based on a stored current BD cycle. In other words, the BDI signal input permission signal 125 is a signal for preventing a signal generated from the BD sensor 106 at an unexpected timing due to, for example, a noise or stray light, from being recognized as the BDI signal, by predicting a normal generation timing of the BDI signal 107.

The BDI signal input permission signal 125 is controlled in such a manner that the BDI signal input permission signal 125 is brought into the H level, for example, after 80 percent of a period of the stored current BD cycle passes since a generation timing of the BDI signal 107. The engine controller 110 recognizes a signal received from the BD sensor 106 as the BDI signal 107 if the signal is detected in a state that the BDI signal input permission signal 125 is at the H level (within a first period). When receiving a signal from the BD sensor 106 in a state that the BDI signal input permission signal 125 is at the L level (out of the first period), the engine controller 110 does not recognize the signal as the BDI signal 107. When the engine controller 110 detects the BDI signal 107, the BDI signal input permission signal 125 is brought into the L level, and the input of the BDI signal 107 is not permitted. In such a configuration, wrong detection of the BDI signal 107 is avoided by the BDI signal input permission signal 125, even if a noise is superimposed on the BDI signal 107 at a clearly abnormal timing in consequence of disturbance, for example, a slight noise.

If the detection timing of the BDI signal 107 deviates significantly, the speed control over the scanner motor 103, which is controlled based on the BD cycle, also deviates significantly. That is, if the speed control of the scanner motor 103 is disturbed significantly, a runaway noise of the scanner motor 103 may occur or a failure of the scanner motor 103 may occur due to excessive rotation of the scanner motor 103 beyond a limit value. Further, a defective image may be generated as a result of fluctuation in start of image writing due to significant deviation of the detection timing of the BDO signal 111. Using the BDI signal input permission signal 125, these failures may be avoided.

[Description About Control in Case where Abnormality Occurs in BD Cycle]

A description will be given of a case where, during image forming, the engine controller 110 recognizes the BD cycle that is out of the normal range (out of a second period) due to, for example, superimposing of a noise on the BDI signal 107 when the BDI signal input permission signal 125 is in a permitted state. The normal range (the second period) means, for example, a range of ±0.1% in a state that the scanner motor 103 rotates at the target number of rotations similarly to the above description. However, this range can be set appropriately for detection accuracy.

Figure 4:
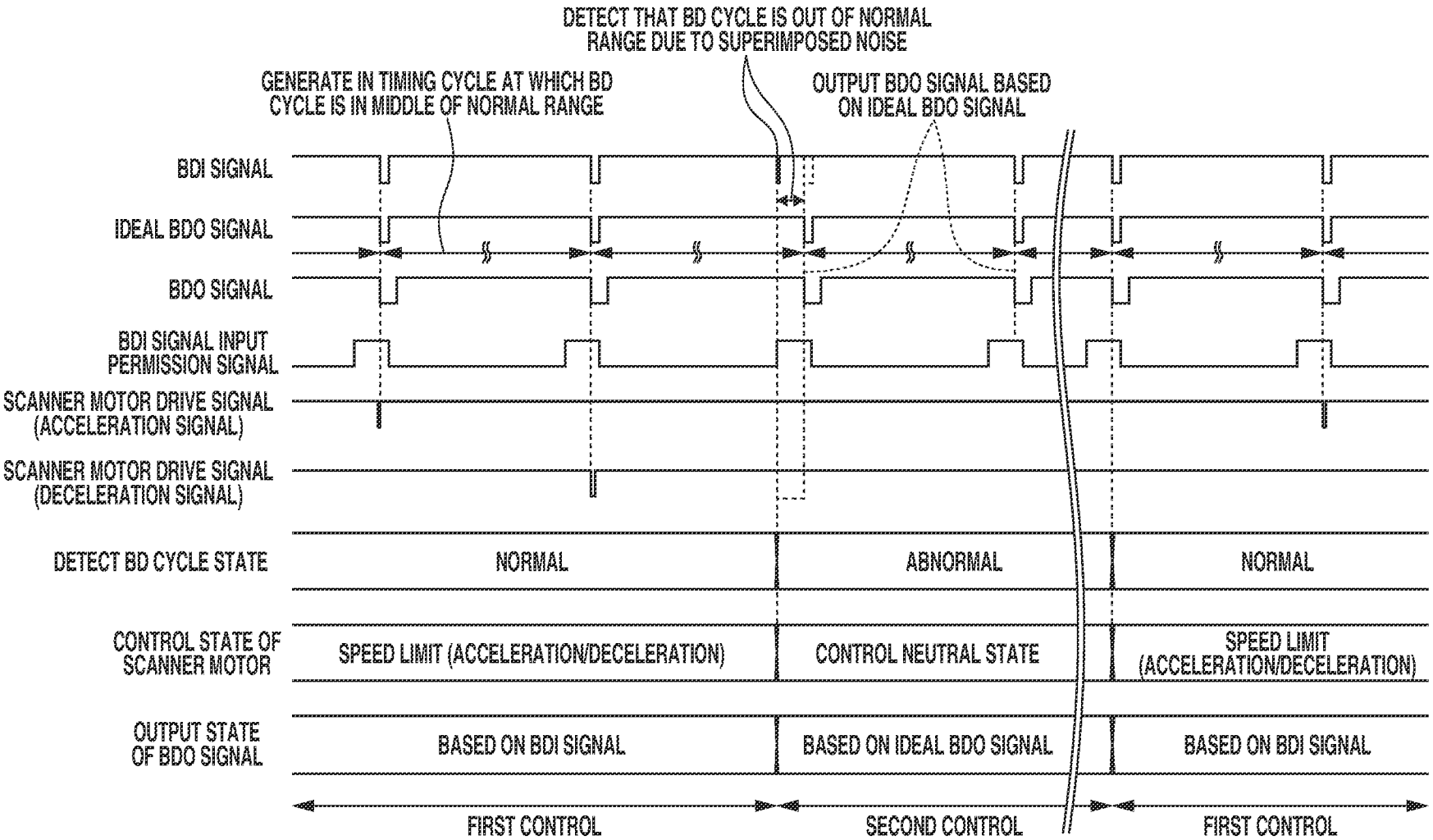
FIG. 4 is timing chart illustrating a case where a beam detection (BD) cycle is abnormal.

FIG. 4 is timing chart illustrating a case where the BD cycle is abnormal. In this case, the speed control of the scanner motor 103 and the generation timing of the BDO signal 111 is not disturbed significantly. Control for immediately suspending the image forming is therefore not have to be performed, but not a few image fluctuations occur in the main scanning direction. This may lead deterioration in image quality. In such a case, control is also performed for a case where abnormality is detected in the BD cycle to form an image with normal quality in the continuing image forming.

The engine controller 110 continuously determines whether the BD cycle is within the normal range until an image is sequentially formed for every line in the main scanning direction in a period during which the image forming is performed by the first control, and the image forming is completed for the last line in the main scanning direction. If the engine controller 110 determines that the BD cycle is within the normal range, the engine controller 110 continues the first control.

Meanwhile, if the engine controller 110 determines that the BD cycle is out of the normal range due to, for example, superimposing of a noise on the BDI signal 107, the engine controller 110 brings the scanner motor 103 into a control neutral state in which both acceleration and deceleration instructions are not executed in order to maintain the constant speed rotating state. That is, both the acceleration signal and the deceleration signal of the scanner motor drive signal 108 are kept at the H level. If the scanner motor 103 is brought into the control neutral state, the scanner motor 103 is eventually shifted into the constant speed rotating state by inertia that maintains a current rotation cycle.

Further, output control for the BDO signal 111 is switched from output control based on the BDI signal 107 to output control based on an ideal BDO signal 130 generated in a timing cycle at which the BD cycle is in the middle of the normal range. The state that the BD cycle is in the middle of the normal range indicates a state in which the scanner motor 103 is supposed to rotate at a target rotation speed and a BD signal is supposed to be detected in an ideal BD cycle. In other words, in a situation that the scanner motor 103 is supposed to be driven to rotate at the target rotation speed, a detection timing of a subsequent BD signal is predicted in such a manner that the BD cycle is within the normal range, and the ideal BDO signal is generated. In the state that the BD cycle is detected to be within the normal range, the engine controller 110 calculates the ideal BDO signal 130 with a start point that is the timing for generating the BDI signal 107. As a method for maintaining the scanner motor 103 in the constant speed rotating state, a method for shifting from the speed control based on the BDI signal 107 to the speed control based on the ideal BDO signal 130 may be used.

As described above, during image forming, the engine controller 110 determines whether the BD cycle is within the normal range. Further, if the engine controller 110 determines that the BD cycle is out of the normal range, the engine controller 110 brings the scanner motor 103 into the constant speed rotating state, and outputs the BDO signal 111 at the timing for generating the ideal BDO signal 130. Such control is referred to as second control hereinafter. Using the second control enables the video controller 117 to avoid an effect of disturbance, for example, slight noise, and continuation of normal image forming even if the noise is superimposed on the BDI signal 107.

In the second control, the scanner motor 103 is brought into the control neutral state in which both the acceleration and deceleration instructions are not executed, and thus shifts to the constant speed rotating state. However, when the scanner motor 103 is brought into the constant speed rotating state, such speed control that causes the rotation speed of the scanner motor 103 to be kept at the target rotation speed cannot be performed. For this reason, the rotation speed fluctuates from the state of rotation in the normal range with the passage of time. In order to suppress such a fluctuation in the rotation speed as small as possible, the engine controller 110 outputs the ideal BDO signal 130 as the BDO signal 111 with a predetermined number of times or during a predetermined time, and then switches the control state from the second control state to the first control state. That is, after the BDO signal 111 is output a predetermined number of times or the BDO signal 111 is output during a predetermined time, the scanner motor 103 is returned to the speed control state. An output state of the BDO signal 111 is also returned to an output state based on detection of the BDI signal 107.

In such a manner, the engine controller 110 determines whether the BD cycle is in the normal range for each main scanning line, and performs the first control or the second control. As a result, the engine controller 110 can continue image forming while suppressing deterioration in the image quality. Further, even if the BD cycle is temporarily out of the normal range, the engine controller 110 can continue image forming while suppressing deterioration in the image quality without immediately suspending the image forming. For this reason, decrease in usability may be also suppressed.

Figure 5:
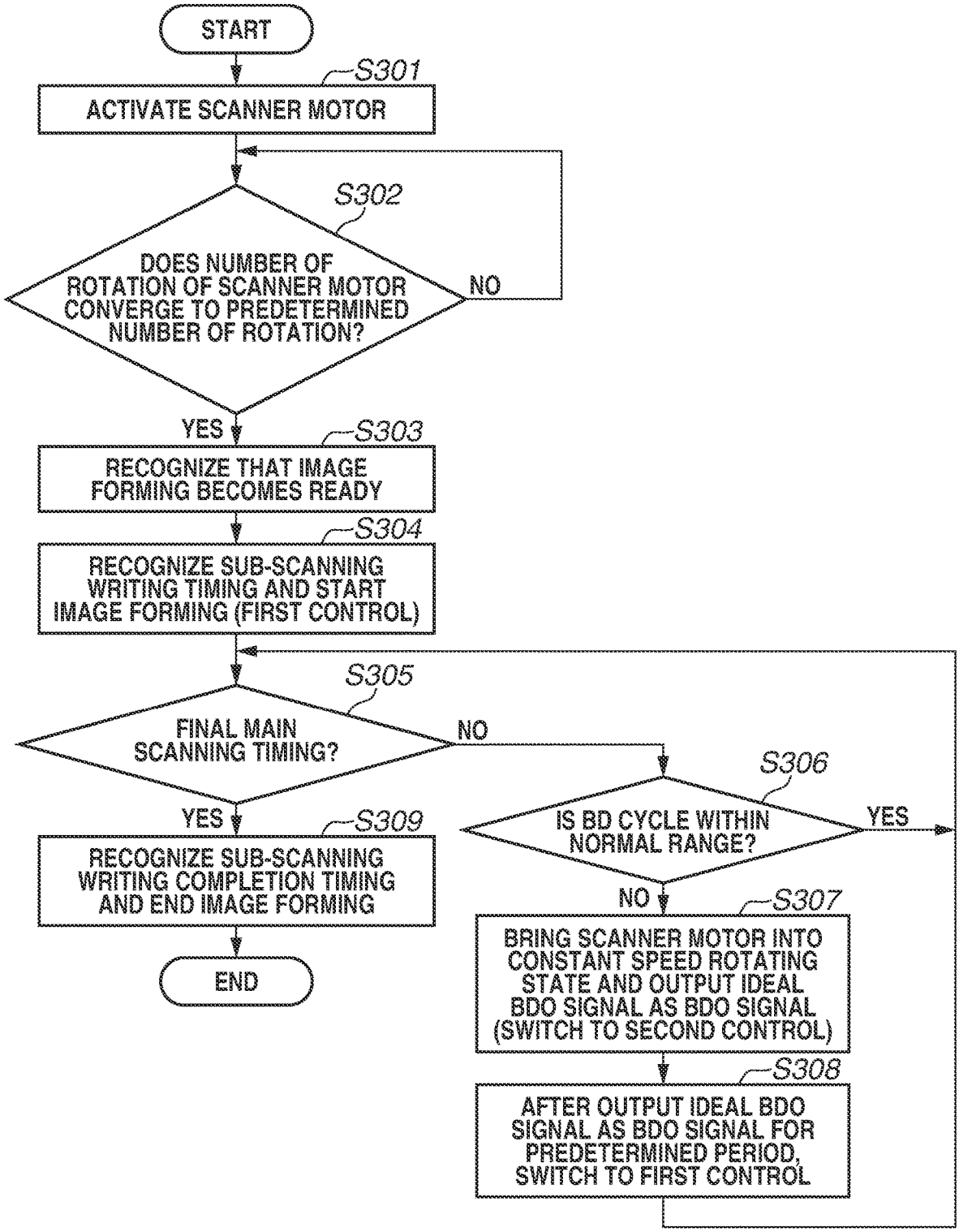
FIG. 5 is a flowchart illustrating control of a BD signal.

FIG. 5 is a flowchart illustrating the control of the BD signal according to the present exemplary embodiment. In step S301, the engine controller 110 activates the scanner motor 103, and starts the speed control for causing the number of rotations of the scanner motor 103 to converge to the target number of rotations. In step S302, the engine controller 110 determines whether the number of rotations of the scanner motor 103 converges to the target number of rotations, based on the BD cycle obtained from the BDI signal 107 sequentially acquired by the BD sensor 106. In a case where the engine controller 110 determines that the number of rotations of the scanner motor 103 converges to the target number of rotations (YES in step S302), the processing proceeds to step S303. In step S303, the engine controller 110 recognizes that preparation for image forming is completed and image forming becomes ready.

In step S304, after the engine controller 110 recognizes a start timing for writing in the sub-scanning direction, the engine controller 110 starts the image forming. That is, the above-described first control is performed in such a manner that the BDO signal 111 synchronized with the fall timing of the BDI signal 107 is transmitted to the video controller 117. In step S305, the engine controller 110 determines whether it is the timing of forming a final line in the main scanning direction during the image forming.

In a case where, in step S305, the engine controller 110 determines that it is not the timing of forming the final line in the main scanning direction (NO in step S305), the processing proceeds to step S306. In step S306, the engine controller 110 determines whether the BD cycle is within the normal range (within a predetermined cycle). In a case where the BD cycle is within the normal range (YES in step S306), the processing returns to step S305. In a case where the BD cycle is out of the normal range (out of the predetermined cycle) (NO in step S306), the processing proceeds to step S307. In step S307, the engine controller 110 first brings the scanner motor 103 into the control neutral state in which both the acceleration and deceleration instructions are not executed in order to maintain the constant speed rotating state. Further, the output control of the BDO signal 111 is switched from the output control based on the BDI signal 107 to the output control based on the ideal BDO signal 130 generated in a timing cycle at which the BD cycle is in the middle of the normal range, that is, the output control of the BDO signal 111 is switched to the above-described second control. In step S308, the engine controller 110 continues the second control for a predetermined period, and then switches the control to the first control again. After that, the processing returns to step S305.

In step S305, in a case where the engine controller 110 determines that it is the timing of forming the last line in the main scanning direction (YES in step S305), the processing proceeds to step S309. In step S309, the engine controller 110 recognizes a sub-scanning writing completion timing and ends the image forming.

In the above described a manner, even if the BD cycle is out of the normal range during image forming, the scanner motor 103 is brought into the constant speed rotating state, and the control is switched to the control for the image forming based on the ideal BDO signal 130. As a result, even if the BD cycle is out of the normal range, the image forming may be continued, and deterioration in the quality of an image to be formed can be suppressed using the ideal BDO signal as the basis. Further, even if the BD cycle is temporarily out of the normal range, the engine controller 110 can continue the image forming while suppressing deterioration in the image quality without immediately suspending the image forming. For this reason, decrease in usability can be also suppressed.

According to the first exemplary embodiment, the control for switching to the ideal BDO signal 130 when the BD cycle is out of the normal range (out of the predetermined cycle) is performed. A second exemplary embodiment describes that the timing of generating the ideal BDO signal 130 for each of the reflection surfaces 102*a*, 102*b*, 102*c*, and

102*d* of the polygon mirror 102 is optimized. Detailed description about the configurations of the image forming apparatus and the scanning device similar to those in the first exemplary embodiment are omitted herein.

In general, the reflection surfaces 102*a*, 102*b*, 102*c*, and 102*d* of the polygon mirror 102 are sometimes not partially parallel with a rotating shaft depending on cutting accuracy in manufacturing or assembly accuracy of the polygon mirror 102 to the scanning device 112. This is a so-called face tangle phenomenon. If deflection scanning is performed using laser light with the polygon mirror 102 in the face tangle state, a scanning position of laser light constantly deviates from a target position. Further, in cutting work, it is difficult to work the reflection surfaces 102*a*, 102*b*, 102*c*, and 102*d* into complete flat surfaces, the respective reflection surfaces sometimes have different curvatures. If the deflection scanning is performed using laser light with the polygon mirror 102 having such reflection surfaces, the scanning position of the laser light constantly deviates from a target position in the main scanning direction on each of the reflection surfaces. This is a phenomenon so-called jitter. In the polygon mirror 102 having such a tendency, it is desirable that the reflection surfaces 102*a*, 102*b*, 102*c*, and 102*d* are identified, and the timing of generating the ideal BDO signal 130 is optimized for each of the reflection surfaces.

[Description About Reflection Surface Specifying Control]

Figure 6:
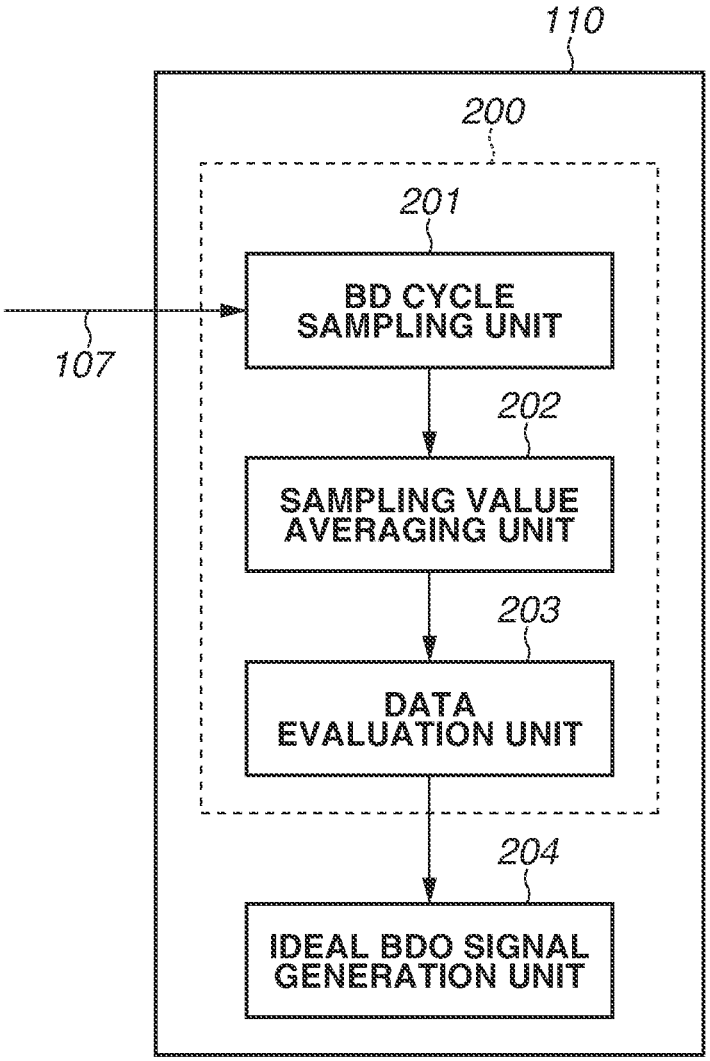
FIG. 6 is a block diagram of a reflection surface specification unit.

FIG. 6 is a block diagram of a reflection surface identifying unit 200. According to the present exemplary embodiment, the engine controller 110 includes the reflection surface identifying unit 200. The reflection surface identifying unit 200 includes a BD cycle sampling unit 201, a sampling value averaging unit 202, and a data evaluation unit 203.

The engine controller 110 activates the scanner motor 103, and after the number of rotations of the scanner motor 103 converges to the target number of rotations, the reflection surfaces 102*a*, 102*b*, 102*c*, and 102*d* of the polygon mirror 102 are identified based on the BD cycle obtained successively. When receiving a sampling start instruction, the BD cycle sampling unit 201 samples the BD cycles of the reflection surfaces 102*a*, 102*b*, 102*c*, and 102*d* at a predetermined number of sampling times to accumulate the BD cycles. When the sampling is completed, the sampling value averaging unit 202 averages the sampled results of the BD cycles for each of the reflection surfaces 102*a*, 102*b*, 102*c*, and 102*d* at a predetermined number of sampling times.

The data evaluation unit 203 then identifies a reference reflection surface using a predetermined algorithm based on the averaged results of the BD cycles for each of the reflection surfaces 102*a*, 102*b*, 102*c*, and 102*d*. Herein, the reference reflection surface identified by the predetermined algorithm may be, for example, a surface where the BD cycle is maximum or minimum. Alternatively, the reference reflection surface may be a surface having a maximum or minimum difference in the BD cycles between one surface and another surface adjacent to the one surface. The reference reflection surface may be any surface that can be uniquely identified by calculating information obtained from the BD cycle. When the reference reflection surface is identified, other reflection surfaces may be uniquely identified based on the reference reflection surface. That is, each of the reflection surfaces is identified by detecting uniqueness of the BD cycles of the reflection surfaces 102*a*, 102*b*, 102*c*, and 102*d*. A timing of scanning the reference reflection surface identified by such control using laser light is transmitted from the data evaluation unit 203 to an ideal BDO signal generation unit 204. The ideal BDO signal generation unit 204 generates the cycle of the ideal BDO signal on the specified reflection surfaces.

[Description About Control in Case where Abnormality Occurs in BD Cycle]

Figure 7:
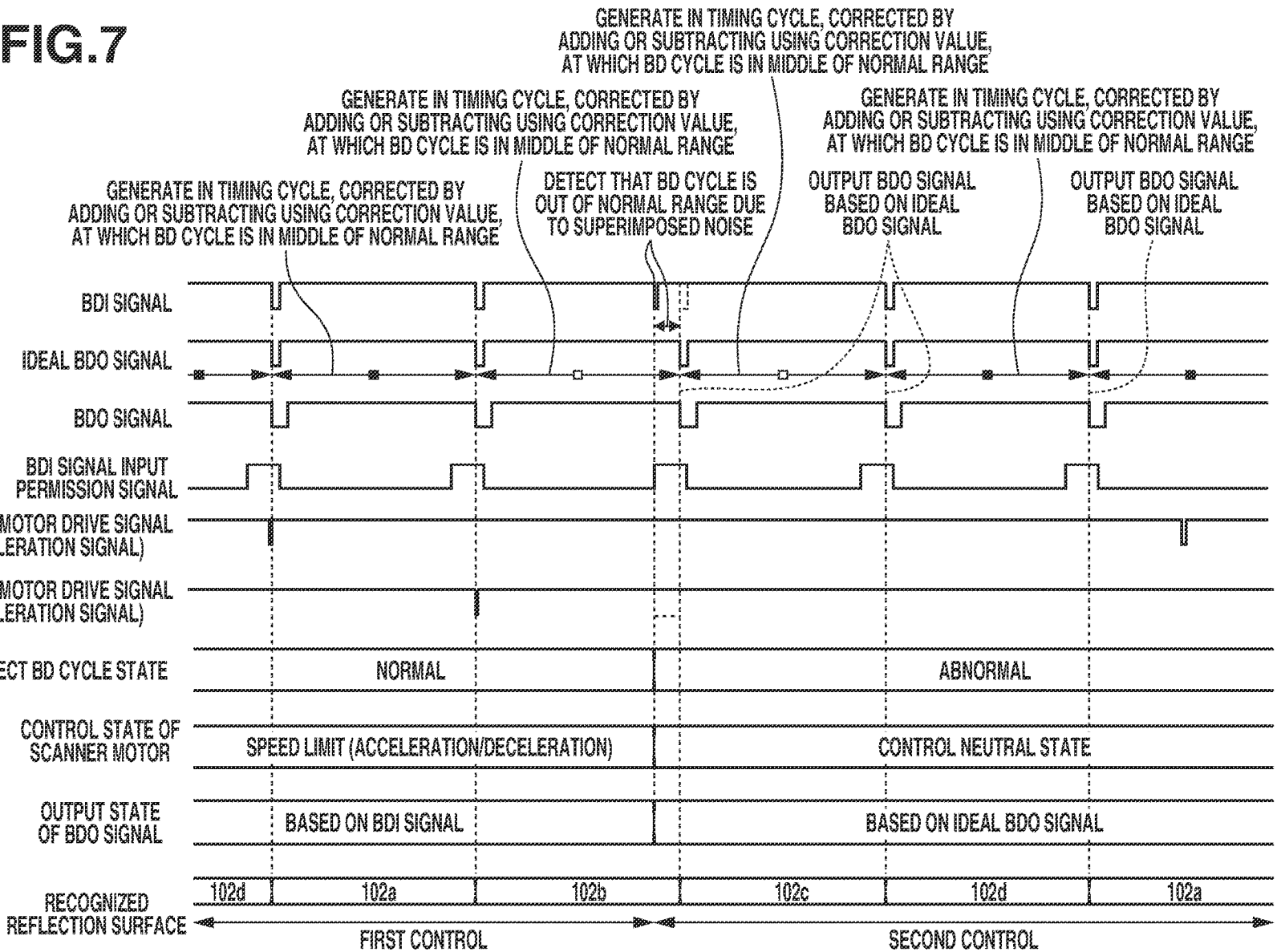
FIG. 7 is a timing chart illustrating a case where the BD cycle is abnormal.

A description will be given of a case where, during image forming, the engine controller 110 recognizes a BD cycle out of the normal range due to, for example, superimposing of a noise on the BDI signal 107 in a state that the BDI signal input permission signal 125 is in a permitted state. FIG. 7 is a timing chart illustrating a case where the BD cycle is abnormal.

If the engine controller 110 determines that the BD cycle is out of the normal range due to, for example, superimposing of a noise on the BDI signal 107, the engine controller 110 changes the output method for the BDO signal 111. That is, the output method for the BDO signal 111 is switched from the output method based on the BDI signal 107 on which the noise is superimposed to the output method based on the ideal BDO signal 130 generated based on the ideal BD cycle of each reflection surface.

When, for example, the reflection surface 102*a* performs scanning using laser light, the ideal BDO signal 130 is generated in a timing cycle at which the BD cycle is in the middle of the normal range. The timing cycle is corrected by adding or subtracting using a correction value related to the reflection surface 102*a* identified by the reflection surface identifying unit 200. Similarly, when the reflection surfaces 102*b*, 102*c*, and 102*d* perform scanning with laser light, the ideal BDO signal 130 is generated by adding or subtracting correction values related to the reflection surfaces 102*b*, 102*c*, and 102*d* identified by the reflection surface identifying unit 200. When the generation timing of the ideal BDO signal 130 varies between the reflection surfaces, the ideal BD cycle also varies between the reflection surfaces. That is, the above-described normal range of the BD cycle is set for the respective reflection surfaces.

The timing chart in FIG. 7 illustrates that the ideal BDO signal 130 is generated for each of the reflection surfaces. During the first control, as described above, the BDO signal 111 is generated based on the BDI signal 107. Although the ideal BDO signal 130 is generated, the generated ideal BDO signal 130 is not used in the first control. If the cycle of the BD signal is out of the normal range on the reflection surface 102*b* due to a noise, the control is switched to the second control, and the BDO signal 111 is generated based on the ideal BDO signal 130.

As described above, more precise control can be performed by changing the generation timing of the ideal BDO signal 130 in a manner corresponding to each of the reflection surfaces 102*a*, 102*b*, 102*c*, and 102*d*. As a result, even if the BD cycle is out of the normal range, image forming can be continued, and deterioration in the quality of an image to be formed can be suppressed using the ideal BDO signal as a reference. Further, even if the BD cycle is temporarily out of the normal range, the engine controller 110 can continue image forming while suppressing deterioration in the image quality without immediately suspending the image forming. For this reason, decrease in usability can be also suppressed.

According to the first and second exemplary embodiments, the control for the switching to the ideal BDO signal 130 when the BD cycle is out of the normal range is described. In a third exemplary embodiment, a description will be given of a method in which determination of whether image forming based on the image signal 118 has been performed immediately around when the BD cycle is out of the normal range is added. Detailed description about the configurations of the image forming apparatus and the scanning device similar to those in the first and second exemplary embodiments are omitted herein.

[Scanning Device]

Figure 8:
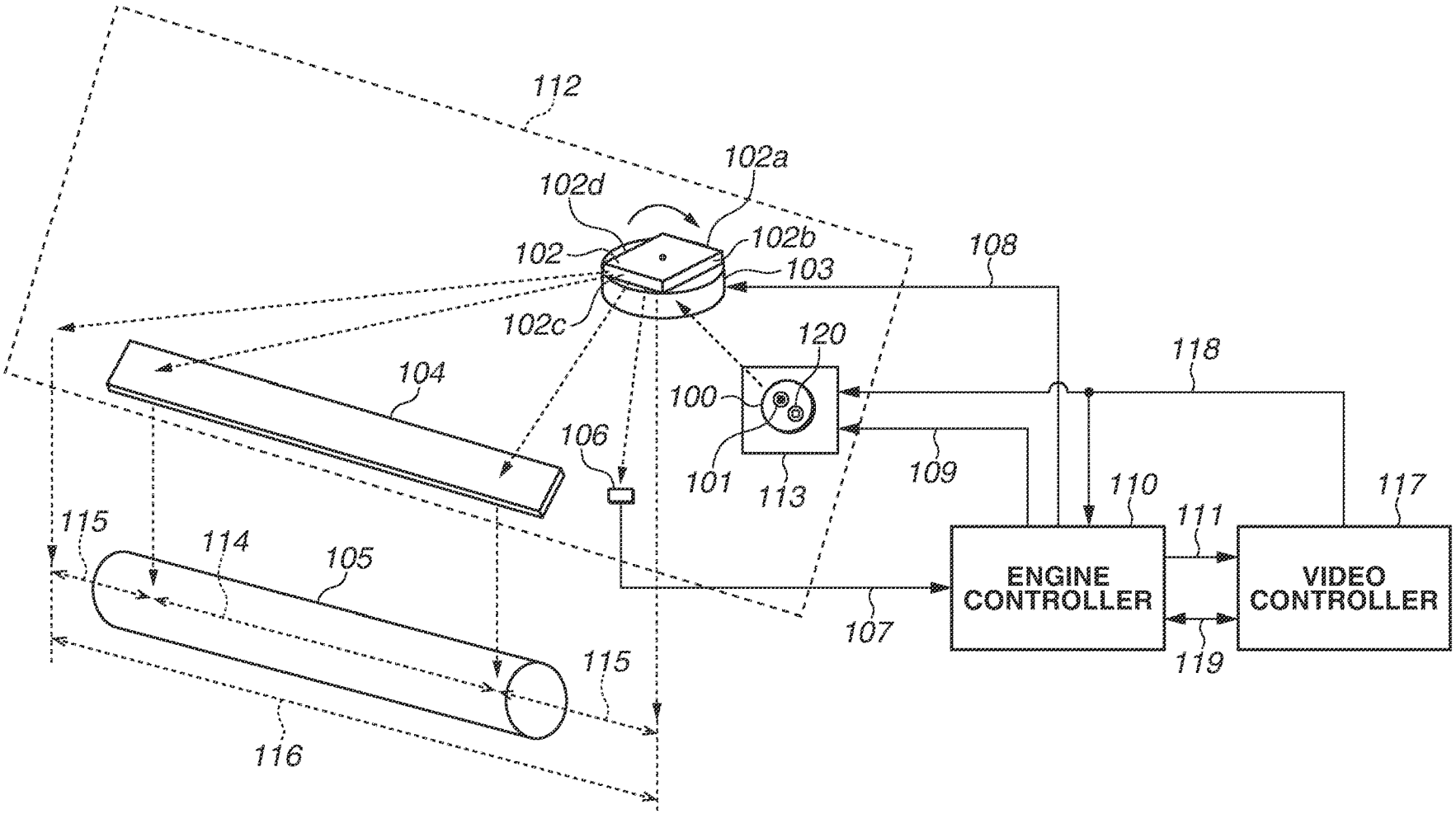
FIG. 8 is a perspective view illustrating a schematic configuration of the scanning device.

FIG. 8 is a perspective view illustrating a schematic configuration of the scanning device 112 according to the present exemplary embodiment. A difference in the configuration between the present exemplary embodiment and the configuration of FIG. 2 in the first exemplary embodiment is that the image signal 118 is input into the engine controller 110. If determining that the BD cycle is out of the normal range, the engine controller 110 determines whether image forming based on the image signal 118 is performed on a main scanning line that is out of the range. The engine controller 110 then determines whether the control is to be switched to the second control.

According to the first and second exemplary embodiments, when the BD cycle is out of the normal range, the control is switched to the second control in order to suppress a defective image in which a fluctuation of the BD cycle causes a fluctuation in the main scanning direction in the image forming. That is, when the BD cycle is determined to be out of the normal range and the image forming based on the image signal 118 is not performed, deterioration in image quality does not occur even if the control is not switched to the ideal BDO signal 130. That is, although the scanner motor 103 is switched to the constant speed rotating state, switching to the control based on the ideal BDO signal 130 is not performed, and the control for outputting the BDO signal 111 based on the generation timing of the BDI signal 107 is continued. Hereinafter, this control is referred to also as third control.

[Description About Control in Case where Abnormality Occurs in BD Cycle]

Figure 9:
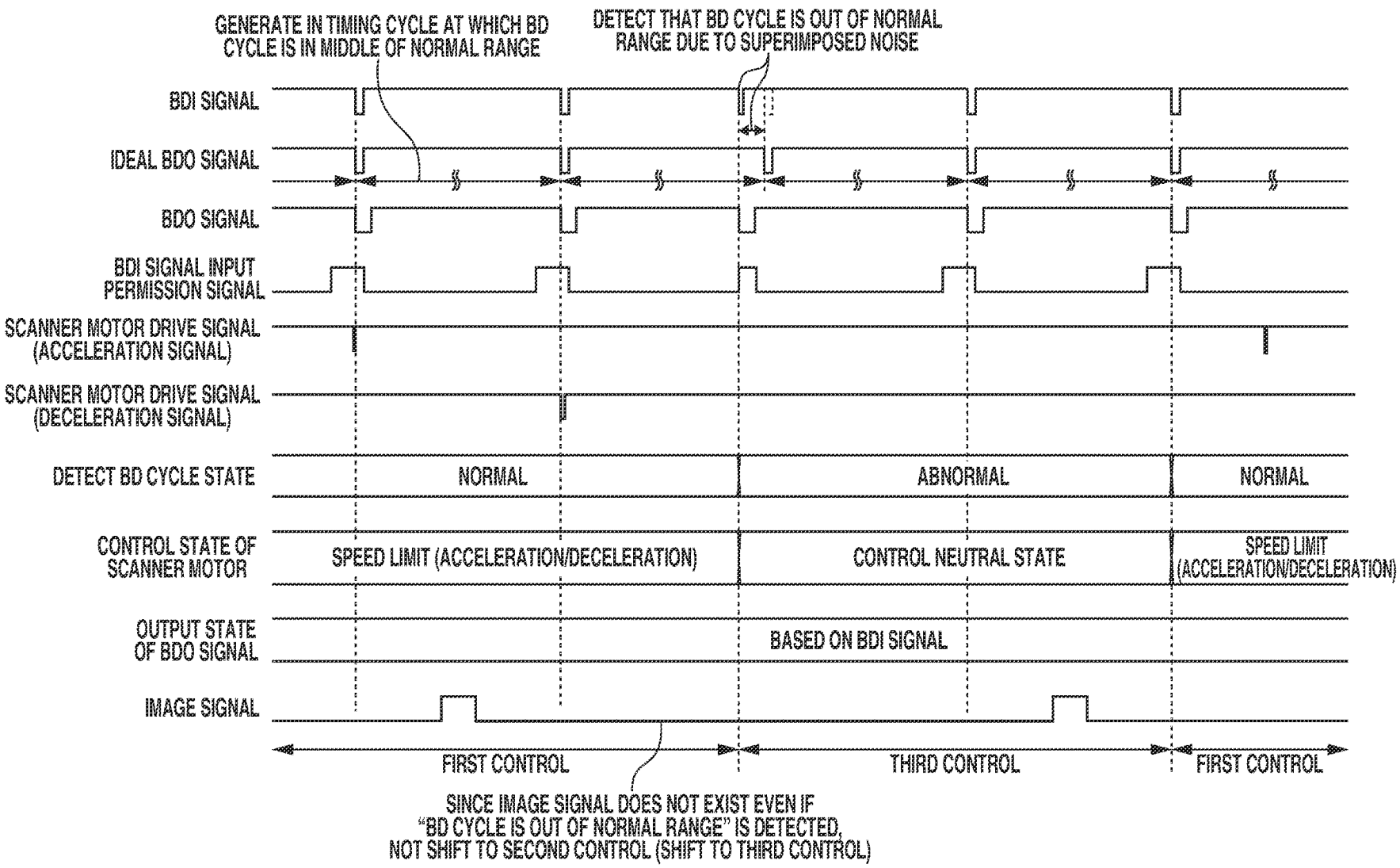
FIG. 9 is a timing chart illustrating a case where the BD cycle is abnormal.
Figure 10:
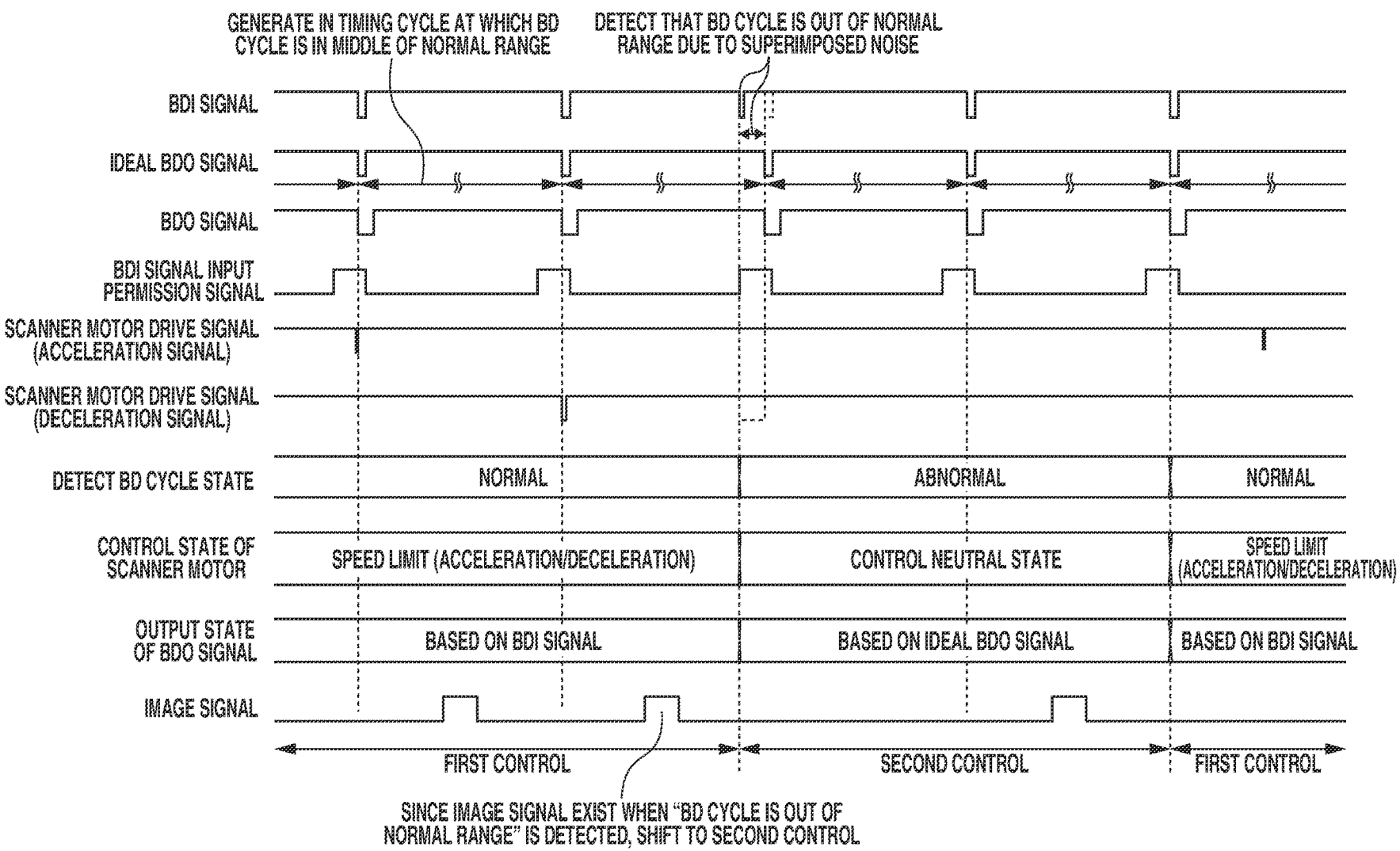
FIG. 10 is a timing chart illustrating a case where the BD cycle is abnormal.

FIG. 9 and FIG. 10 are timing charts illustrating the case where the BD cycle is abnormal. The details described in the first exemplary embodiment are omitted, and characteristics of the present exemplary embodiment are described. The engine controller 110 determines whether the BD cycle is within the normal range. If the BD cycle is out of the normal range, the engine controller 110 determines whether the image forming based on the image signal 118 is performed on the main scanning line that is out of the normal range.

FIG. 9 is the timing chart illustrating a case where, when the BD cycle is out of the normal range, the image forming based on the image signal 118 is not performed on the main scanning line that is out of the range. FIG. 10 is the timing chart illustrating a case where, when the BD cycle is out of the normal range, the image forming based on the image signal 118 is performed on the main scanning line that is out of the range. When the image signal 118 in the timing charts is at the H level, the image signal 118 exists on the main scanning line, but when at the L level, the image signal 118 does not exist on the main scanning line.

In FIG. 9, if the engine controller 110 determines that the BD cycle is out of the normal range, the image forming based on the image signal 118 is not performed on the main scanning line, whereby the engine controller 110 switches the control from the first control to the third control. In FIG. 10, if the engine controller 110 determines that the BD cycle is out of the normal range, the image forming based on the image signal 118 is performed on the main scanning line, whereby the engine controller 110 switches the control from the first control to the second control. As illustrated in FIG. 9, since the control for generating the BDO signal 111 based on the ideal BDO signal 130 is not switched, the BDO signal 111 is continued to be stably generated based on the BDI signal 107. That is, robustness is heightened by suppressing an effect that might be accidentally caused by switching the control for generating the BDO signal 111.

Figure 11:
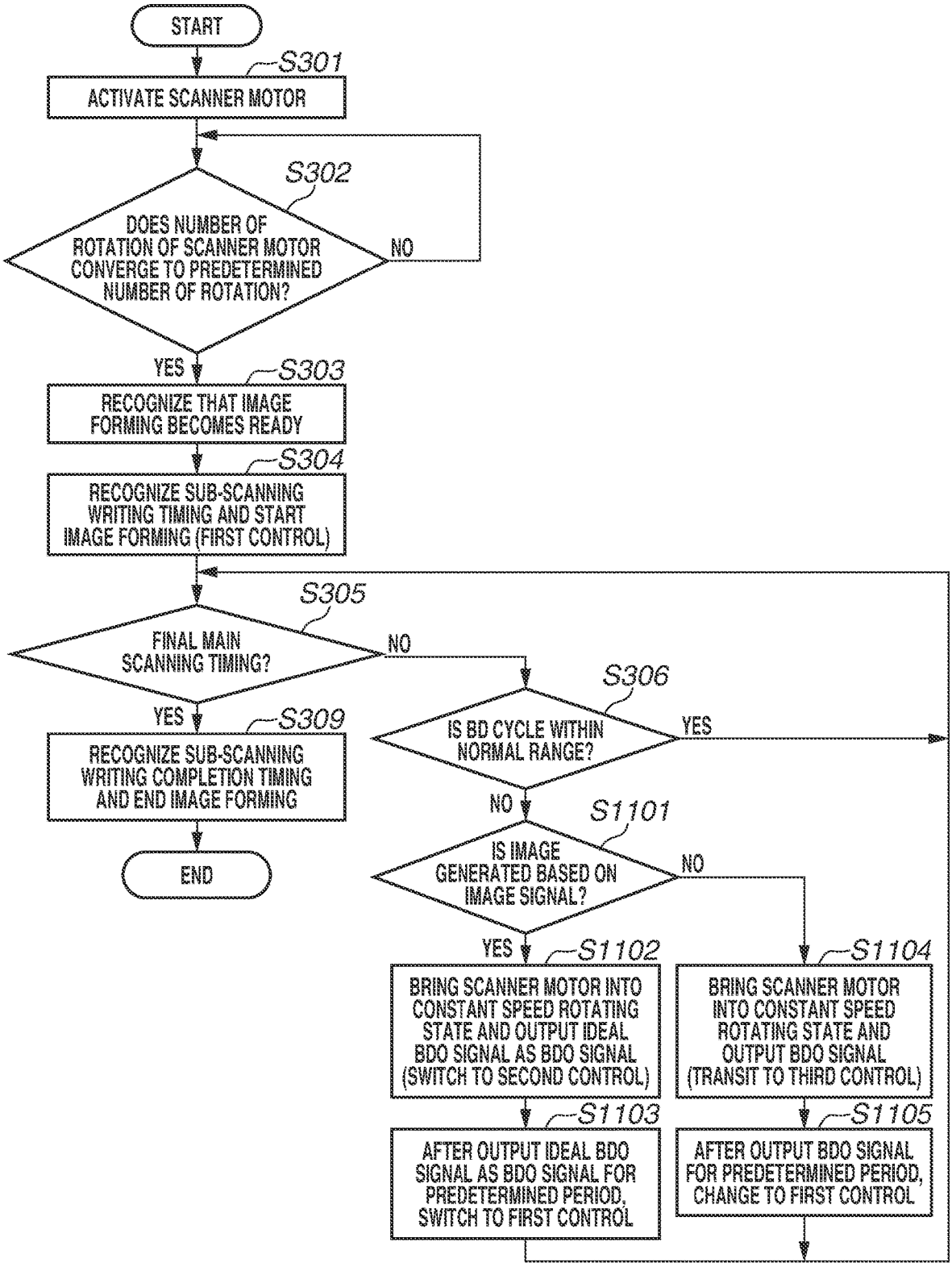
FIG. 11 is a flowchart illustrating control of the BD signal.

FIG. 11 is a flowchart illustrating the control of the BD signal according to the present exemplary embodiment. Steps similar to those described with reference to the flowchart in FIG. 5 are denoted by similar numbers, and detailed description thereof is omitted. In step S306, the engine controller 110 determines that the BD cycle is out of the normal range (out of the predetermined range) (NO in step S306), and the processing proceeds to step S1101. In step S1101, the engine controller 110 determines whether the image forming based on the image signal 118 is performed on the main scanning line that is out of the normal range.

In step S1101, in a case where the image forming based on the image signal 118 is performed on the main scanning line (YES in step S1101), the processing is proceeds to step S1102. In step S1102, the engine controller 110 brings the scanner motor 103 into the control neutral state in which both the acceleration and deceleration instruction are not executed to maintain the scanner motor 103 in the constant speed rotating state. Further, the output control of the BDO signal 111 is switched from the output control based on the BDI signal 107 to the output control based on the ideal BDO signal 130 generated in the timing cycle at which the BD cycle is in the middle of the normal range. That is, the output control of the BDO signal 111 is switched to the above-described second control. In step S1103, the engine controller 110 continues the second control for a predetermined period and then switches the control back to the first control. After that, the processing returns to step S305.

In step S1101, in a case where the image forming based on the image signal 118 is not performed on the main scanning line (NO in step S1101), the processing proceeds to step S1104. In step S1104, the engine controller 110 brings the scanner motor 103 into the control neutral state where both the acceleration and deceleration instructions are not executed in order to main the scantier motor 103 in the constant speed rotating state. Meanwhile, the output control of the BDO signal 111 is switched to the above-described third control in which the output control based on the BDI signal is still maintained. In step S1105, the engine controller 110 continues the third control for a predetermined period and switches the control back to the first control. As a result, the processing returns to step S305.

As described above, the engine controller 110 can determine whether to switch the control to the control using the ideal BDO signal 130 by determining whether the control is to be switched to the second control depending on presence or absence of the image signal 118. As a result, since unnecessary switch to the control using the ideal BDO signal 130 can be suppressed, robustness can be heightened.

According to the present disclosure, even if abnormality occurs in the BD cycle, control can be performed in such a manner that decrease in usability is suppressed.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2017-252544, filed Dec. 27, 2017, which is hereby incorporated by reference herein in its entirety.

What is claimed is:

1. An image forming apparatus comprising:

a light source;

a rotational polygon mirror having a plurality of reflection surfaces and configured to reflect light output from the light source while being rotationally driven;

a driving unit configured to drive the rotational polygon mirror;

a detection unit configured to detect light reflected by the rotational polygon mirror and output a first signal based on the detection; and a control unit configured to output a second signal that is a synchronization signal for controlling start of writing in a main scanning direction, wherein, in a case where a cycle of the first signal is within a predetermined cycle, the control unit performs first control to output the second signal based on the first signal, and wherein, in a case where the cycle of the first signal is outside the predetermined cycle, the control unit performs second control to output the second signal based on a predicted cycle of the first signal and, after the control unit performs second control and outputs the second signal at a predetermined number of times, the control unit switches the second control to the first control.

2. The image forming apparatus according to claim 1, wherein the control unit controls acceleration and deceleration of the driving unit based on the cycle of the first signal.

3. The image forming apparatus according to claim 1, wherein, in performing the second control, the control unit causes the driving unit not to accelerate or decelerate based on the cycle of the first signal.

4. The image forming apparatus according to claim 1, further comprising a storage unit configured to store the cycle of the first signal, wherein, in response to the first signal being output from the detection unit, the control unit obtains a cycle of the first signal and updates the cycle of the first signal stored in the storage unit to the obtained cycle of the first signal.

5. The image forming apparatus according to claim 4, wherein the control unit predicts, based on the cycle of the first signal stored in the storage unit, a first period within which the first signal is to be output by the detection unit after the first period prediction.

6. The image forming apparatus according to claim 5, wherein, in a case where a subsequent signal is output by the detection unit in a period outside the first period, the control unit does not recognize the output subsequent signal as the first signal, and wherein, in a case where the subsequent signal is output by the detection unit in a period within the first period, the control unit recognizes the output subsequent signal as the first signal.

7. The image forming apparatus according to claim 4, wherein the control unit predicts, based on the cycle of the first signal stored in the storage unit, a second period, shorter than the first period, within which whether the first signal is normally detected within the first period is determined.

8. The image forming apparatus according to claim 7, wherein, in a case where a signal is output from the detection unit within the second period, the control unit performs the first control and wherein, in a case where a signal is output from the detection unit outside the second period, the control unit performs the second control.

9. The image forming apparatus according to claim 1, wherein, in performing the second control, the control unit predicts a first cycle in such a manner that the cycle of the first signal is within the predetermined cycle under a condition that the driving unit is driven at a target rotation speed.

10. The image forming apparatus according to claim 1, wherein the control unit is configured to identify which reflection surface among the plurality of reflection surfaces of the rotational polygon mirror reflects light, and wherein, in performing the second control, the control unit predicts a first cycle which is varied depending on the identified reflection surface.

11. The image forming apparatus according to claim 10, wherein the control unit is configured to identify a reference reflection surface among the plurality of reflection surfaces based on the cycle of the first signal, and is configured to identify each of the plurality of reflection surfaces based on the reference reflection surface.

12. The image forming apparatus according to claim 1, further comprising an image control unit configured to generate image data, wherein, in a case where the image data is generated, the image control unit transmits the image data to the control unit based on the second signal.

13. The image forming apparatus according to claim 1, wherein, in a case where the cycle of the first signal is outside the predetermined cycle, the control unit performs control to determine whether image forming, based on an image signal, has been performed on a main scanning line with the cycle of the first signal being outside the predetermined cycle, wherein, in a case where the image forming has been performed, the control unit performs the second control, wherein, in a case where the image forming has not been performed, the control unit outputs the second signal based on the first signal, and wherein, based on the cycle of the first signal, the control unit performs third control in which the driving unit does not accelerate or decelerate.

14. An image forming apparatus comprising:

a light source;

a rotational polygon mirror having a plurality of reflection surfaces and configured to reflect light output from the light source while being rotationally driven;

a driving unit configured to drive the rotational polygon mirror;

a detection unit configured to detect light reflected by the rotational polygon mirror and output a first signal based on the detection; a storage unit configured to store a cycle of the first signal; and a control unit configured to output a second signal that is a synchronization signal for controlling start of writing in a main scanning direction, wherein, in a case where a cycle of the first signal is within a predetermined cycle, the control unit performs first control to output the second signal based on the first signal, wherein, in a case where the cycle of the first signal is outside the predetermined cycle, the control unit performs second control to output the second signal based on a predicted cycle of the first signal, wherein, in response to the first signal being output from the detection unit, the control unit obtains a cycle of the first signal and updates the cycle of the first signal stored in the storage unit to the obtained cycle of the first signal, and wherein the control unit predicts, based on the cycle of the first signal stored in the storage unit, a first period within which the first signal is to be output by the detection unit after the first period prediction.

15. An image forming apparatus comprising:

a light source;

a rotational polygon mirror having a plurality of reflection surfaces and configured to reflect light output from the light source while being rotationally driven;

a driving unit configured to drive the rotational polygon mirror;

a detection unit configured to detect light reflected by the rotational polygon mirror and output a first signal based on the detection; and a control unit configured to output a second signal that is a synchronization signal for controlling start of writing in a main scanning direction, wherein, in a case where a cycle of the first signal is within a predetermined cycle, the control unit performs first control to output the second signal based on the first signal, wherein, in a case where the cycle of the first signal is outside the predetermined cycle, the control unit performs second control to output the second signal based on a predicted cycle of the first signal, and wherein, in performing the second control, the control unit predicts a first cycle in such a manner that the cycle of the first signal is within the predetermined cycle under a condition that the driving unit is driven at a target rotation speed.

16. An image forming apparatus comprising:

a light source;

a rotational polygon mirror having a plurality of reflection surfaces and configured to reflect light output from the light source while being rotationally driven;

a driving unit configured to drive the rotational polygon mirror;

a detection unit configured to detect light reflected by the rotational polygon mirror and output a first signal based on the detection; and a control unit configured to output a second signal that is a synchronization signal for controlling start of writing in a main scanning direction, wherein, in a case where a cycle of the first signal is within a predetermined cycle, the control unit performs first control to output the second signal based on the first signal, wherein, in a case where the cycle of the first signal is outside the predetermined cycle, the control unit performs second control to output the second signal based on a predicted cycle of the first signal, wherein the control unit is configured to identify which reflection surface among the plurality of reflection surfaces of the rotational polygon mirror reflects light, and wherein, in performing the second control, the control unit predicts a first cycle which is varied depending on the identified reflection surface.

17. An image forming apparatus comprising:

a light source;

a rotational polygon mirror having a plurality of reflection surfaces and configured to reflect light output from the light source while being rotationally driven;

a driving unit configured to drive the rotational polygon mirror;

a detection unit configured to detect light reflected by the rotational polygon mirror and output a first signal based on the detection;

an image control unit configured to generate image data; and a control unit configured to output a second signal that is a synchronization signal for controlling start of writing in a main scanning direction, wherein, in a case where a cycle of the first signal is within a predetermined cycle, the control unit performs first control to output the second signal based on the first signal, wherein, in a case where the cycle of the first signal is outside the predetermined cycle, the control unit performs second control to output the second signal based on a predicted cycle of the first signal, wherein the control unit is configured to identify which reflection surface among the plurality of reflection surfaces of the rotational polygon mirror reflects light, and wherein, in a case where the image data is generated, the image control unit transmits the image data to the control unit based on the second signal.

18. An image forming apparatus comprising:

a light source;

a rotational polygon mirror having a plurality of reflection surfaces and configured to reflect light output from the light source while being rotationally driven;

a driving unit configured to drive the rotational polygon mirror;

a detection unit configured to detect light reflected by the rotational polygon mirror and output a first signal based on the detection;

an image control unit configured to generate image data; and a control unit configured to output a second signal that is a synchronization signal for controlling start of writing in a main scanning direction, wherein, in a case where a cycle of the first signal is within a predetermined cycle, the control unit performs first control to output the second signal based on the first signal, wherein, in a case where the cycle of the first signal is outside the predetermined cycle, the control unit performs second control to output the second signal based on a predicted cycle of the first signal and performs control to determine whether image forming, based on an image signal, has been performed on a main scanning line with the cycle of the first signal being outside the predetermined cycle, wherein, in a case where the image forming has been performed, the control unit performs the second control, wherein, in a case where the image forming has not been performed, the control unit outputs the second signal based on the first signal, and wherein, based on the cycle of the first signal, the control unit performs third control in which the driving unit does not accelerate or decelerate.

* * * * *